US006675544B1

(12) United States Patent
Ou et al.

(10) Patent No.: US 6,675,544 B1
(45) Date of Patent: Jan. 13, 2004

(54) COMPOSITE WOOD PANELS HAVING TONGUE AND GROOVE EDGES

(75) Inventors: Nian-hua Ou, Watkinsville, GA (US); Jianhua Pu, Watkinsville, GA (US)

(73) Assignee: J.M. Huber Corporation, Edison, NJ (US)

( * ) Notice: Subject to any disclaimer, the term of this patent is extended or adjusted under 35 U.S.C. 154(b) by 203 days.

(21) Appl. No.: 09/723,562

(22) Filed: Nov. 28, 2000

(51) Int. Cl.[7] ..... E04D 1/00

(52) U.S. Cl. ..... 52/539; 52/553; 52/592.1; 52/589.1; 52/590.3; 52/591.3; 52/592.4

(58) Field of Search ..... 52/745.08, 745.19, 52/539, 533, 553, 534, 588.1, 592.1, 592.4, 589.1, 390, 586.2, 591.2, 591.3, 590.2, 590.3; 403/334, 345

(56) References Cited

U.S. PATENT DOCUMENTS

| | | | | |
|---|---|---|---|---|
| 3,987,599 A | | 10/1976 | Hines | |
| 4,095,913 A | | 6/1978 | Pettersson | |
| 4,807,416 A | | 2/1989 | Parasin | |
| 5,335,473 A | | 8/1994 | Chase | |
| 5,502,939 A | * | 4/1996 | Zadok et al. | 52/309.9 |
| 5,540,025 A | | 7/1996 | Takehara et al. | |
| 5,661,937 A | | 9/1997 | Doppler et al. | |
| 6,098,365 A | * | 8/2000 | Martin et al. | 52/592.1 |
| 6,145,261 A | * | 11/2000 | Godfrey et al. | 52/302.1 |
| 6,216,409 B1 | * | 4/2001 | Roy et al. | 52/589.1 |
| 6,247,285 B1 | * | 6/2001 | Moebus | 52/589.1 |

* cited by examiner

*Primary Examiner*—Carl D. Friedman
*Assistant Examiner*—Chi Q. Nguyen
(74) *Attorney, Agent, or Firm*—Carlos Nieves; David Mitchell Goodrich

(57) ABSTRACT

A composite wood panel having a first and second longitudinal edge, wherein the first edge includes a groove and the second edge includes a tongue for interlocking and engaging the complementary edges of an adjacent tongue and groove wood panel. The groove has two sides and a base transverse thereto, and the tongue has two side walls and a head extending outward from the second longitudinal edge, thereby forming a juncture between the side walls of the tongue and the second longitudinal edge. A shoulder is located at the juncture between one side wall of the tongue and the second longitudinal edge. Upon assembly of two complementary wood panels as described above, a novel tongue and groove joint is formed wherein the shoulder will abut the first longitudinal edge, thus preventing the tongue from being completely introduced into the complementary groove. As a result, a first aperture is formed between the head of the tongue and the base of the groove and a second aperture is formed between the first and second longitudinal edge both above and below the engaged tongue and groove.

8 Claims, 2 Drawing Sheets

COMPOSITE WOOD PANELS HAVING TONGUE AND GROOVE EDGES

FIELD OF THE INVENTION

The present invention relates to composite wood panels each having a tongue edge and a groove edge, the tongue and groove edges being complementary to permit interconnection of the panels. In particular, the present invention relates to wood panels having tongue and groove edges and means for maintaining a space between panels when the tongue of one panel is engaged with the groove of another.

BACKGROUND OF THE INVENTION

Interconnecting tongue and groove wood panels or boards are well known and widely used in the construction industry. These panels are commonly constructed from plywood, particleboard, waferboard, strandboard or other composite wood product materials. Tongue and groove composite wood panels are particularly well suited for installation on a joist framing assembly because the interlocking edges of the panels reduce vertical offset between adjacent panels, thereby providing a smoother structural sub-floor. In addition, the load carrying transfer along the interconnected edges prevents relative movement between adjacent panel edges as persons walk along the floor, thereby reducing floor squeaking. Typically, carpet, tile or a hardwood is installed over a structural sub-floor to provide a finished floor surface.

While tongue and groove composite wood panels are generally very useful, such composite panels commonly swell and expand due to the absorption of moisture by the panel. This expansion causes the interconnected edges of the adjacent wood panels to press tightly against one another creating stress along the panel edges. As a result, the interconnected wood panels begin to buckle and bow. In addition, the stress along the panel edges can cause undesirable popping, cracking or squeaking when persons step upon or near the joints.

Accordingly, there is a need in the building industry for tongue and groove wood panels which reduce unwanted stress along the interconnected panel edges during panel expansion, while continuing to reduce vertical offset and provide effective load carrying transfer along the length of the tongue and groove joint.

SUMMARY OF THE INVENTION

In summary, the invention relates to a composite wood panel comprising a first and second longitudinal edge, wherein the first edge includes a groove and the second edge includes a tongue, for interlocking and engaging the complementary edges of adjacent tongue and groove wood panels. Preferably, the groove has two sides and a base transverse thereto, and the tongue has two side walls and a head extending outward from the second longitudinal edge, thereby forming a juncture between the side walls of the tongue and the second longitudinal edge. A shoulder is located at the juncture between one side wall of the tongue and the second longitudinal edge. Upon assembly of two complementary wood panels to form a tongue and groove joint, the shoulder will abut the first longitudinal edge, thus preventing the tongue from being completely introduced into the complementary groove. As a result, an aperture is formed between the head of the tongue and the base of the groove. Further, an aperture is formed between the first and second longitudinal edge both above and below the engaged tongue and groove.

The apertures allow for subsequent expansion and swelling along the longitudinal edge of the interconnected panels. Particularly, the shoulder will deform or compress as the interconnected panels expand, thereby reducing stress along the edges of the interconnected panels. Accordingly, as the wood panels expand and swell due to the absorption of moisture, undesired stress along the longitudinal edges of the interconnected composite wood panels is reduced or eliminated.

In this way, the invention provides high strength tongue and groove composite wood panels which may be utilized in flooring or sub-flooring assembly free of buckling, bowing or cracking resulting from stress and pressure along the interconnected wood panel edges. Further, the reduction of stress along the edges of interconnected wood panels will reduce the undesired popping or squeaking due to persons walking along or near the panel joints.

DETAILED DESCRIPTION OF THE INVENTION

In a preferred embodiment, the invention relates to a tongue and groove composite wood panel, plank or board for use in the assembly of flooring and sub-flooring. Alternatively, the wood panels of this invention may also be utilized as wall boards, decks, roofing, countertops or any other suitable surface wherein the wood panels employed are subject to undesired swelling or expansion which may create pressure or stress along interconnected panel joints.

Figure 1:
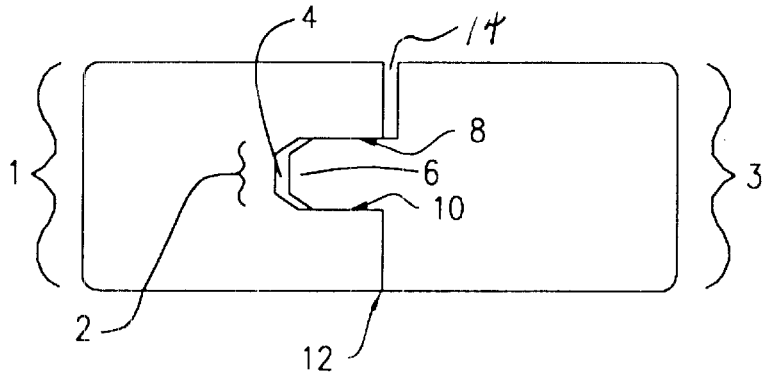
(PRIOR ART) FIG. 1
FIG. 1 illustrates a cross-sectional profile of a tongue and groove joint utilized in the prior art.

FIG. 1 illustrates the cross-sectional profile of a tongue and groove joint, approved by the American Plywood Association, currently utilized in flooring and sub-flooring assembly. Referring to FIG. 1, a board or panel of wood 1 is provided with a rectangular groove 2 on one side edge and a complementary second board or panel 3 is provided with a rectangular section tongue 6, having disproportionate upper 8 and lower 10 side walls, on a second side edge facing the groove 2. The tongue is formed such that the lower side wall 10 is of a length shorter than the upper side wall 8. Thus, when the boards or panels 1 and 3 are connected to form a tongue and groove joint, the edge of panel 1 below the groove 2, and the edge of panel 3 below the tongue 6, abut each other to form a tight bottom joint 12. A first aperture 4 is formed between the partially engaged tongue and groove and a second aperture 14 is formed between the side edges of panel 1 and 3 above the tongue and groove joint.

When such interconnected boards or panels are subjected to moisture, the boards or panels tend to expand. Since the boards or panels are substantially rigidly interconnected by the tight bottom joint 12, there is no opportunity to reduce the resulting stress along the joint and consequently the boards or panels tend to buckle or bow. In addition, the stress along the joint can result in cracking and squeaking along the edges of the interconnected boards or panels when persons walk or step along or near the joint. The present invention overcomes these deficiencies in the prior art by providing an area for panel expansion both above and below the engaged tongue and groove joint, without compromising the strength and utility of the tongue and groove intersection.

Figure 2:
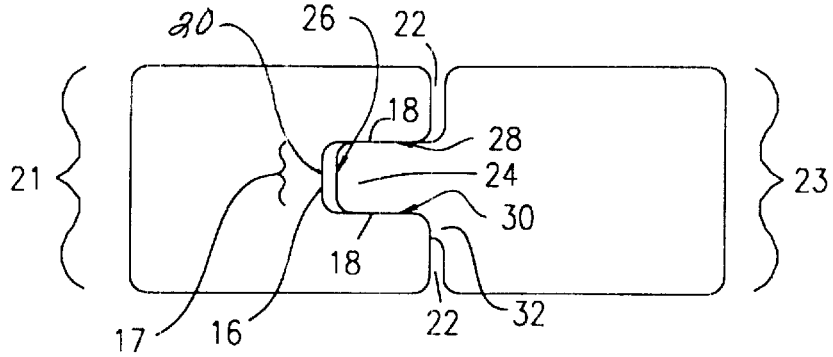
FIG. 2 illustrates a cross-sectional profile of a tongue and groove joint in accordance with a preferred embodiment of this invention.

FIG. 2 illustrates the cross-sectional profile of a tongue and groove joint formed by engaging similar tongue and groove composite wood panels in accordance with a preferred embodiment of this invention. A first board or panel of wood 21 is provided with a groove 17 along a first longitudinal edge and a complementary second board or panel 23 is provided with tongue 24 along a second longitudinal edge, facing the groove. The groove has two sides 18 and a base 16 transverse thereto. The tongue is has a head 26, an upper side wall 28 and a lower side wall 30 extending outward from the second longitudinal edge, thereby forming a juncture between the side walls of the tongue and the second longitudinal edge. The tongue may extend uninterrupted along the entire length of the longitudinal edge, or in the alternative, the tongue may be segmented to allow for water to pass in between the tongue segments. A shoulder 32 is located at the juncture between either the upper 28 or lower 30 side wall of the tongue and the second longitudinal edge. Preferably, as illustrated in FIG. 2, the shoulder 32 is located at the juncture between the second longitudinal edge and the lower side wall 30.

Upon assembly of the first panel 21 with the second panel 23 to form a tongue and groove joint, the shoulder 32 will abut the first longitudinal edge, thus preventing the tongue 24 from being completely introduced into the complementary groove 17. As a result, a first aperture 20 is formed between the head of the tongue 26 and the base of the groove 16. A second aperture 22 is formed between the first and second longitudinal edge of the complementary wood panels both above and below the engaged tongue and groove. Preferably, the second aperture is between ⅛ to 1/16" inches wide for interconnected wood panels having a thickness in the range of 0.25 (¼") to 1.5 (1½") inches. However, a smaller or larger aperture may be utilized depending on the composition of the panels and the expected exposure to moisture. In this way, the edges of the complementary wood panels do not form a tight joint along the panel edge and the apertures allow for expansion of the interconnected wood panels. Moreover, the resulting tongue and groove joint provides effective load carrying transfer along the length of the joint and reduces vertical offset between the interconnected wood panels.

Preferably, the shoulder is formed so that it is relatively weak, compared with the overall strength of the first longitudinal edge to which the shoulder abuts. As a result, the shoulder will partially deform or compress as a result of the force applied by the first longitudinal edge when the panels expand. In this way, the interconnected wood panels may expand slightly, allowing the panels to absorb moisture without bowing or cracking along the edges of the panel. The expansion of the panels may continue until the edges of the complementary panels come into contact or until the shoulder is unable to deform any further. It is preferred that the shoulder be of such size and shape that, should expansion of the interconnected panels occur, the shoulder may compress under the pressure of the expansion without visible damage or modification at the panel surface. Further, the shoulder may be of any shape or form and may be provided at any convenient place along the longitudinal edge from which the tongue extends. In general, the shoulder acts as a spacer to create an aperture between the longitudinal edges of the interconnected wood panels and an aperture between the head of the tongue and the base of the groove. The size of the aperture created depends on the needs of the user, and preferably is adjusted by the size and shape of the shoulder, or in the alternative, the size and shape of the complementary tongue and groove.

Figure 3:
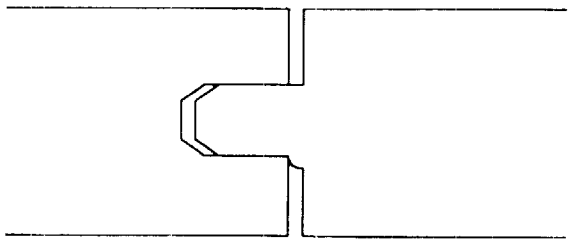
FIG. 3 illustrates a cross-sectional profile of a tongue and groove joint in accordance with an alternative embodiment of this invention.

FIG. 3 illustrates the cross-sectional profile of a further alternative embodiment of the invention. Particularly, the head of the tongue and base of the groove contain a beveled edge, as opposed to the rounded edges of the tongue and groove illustrated in FIG. 2. Further, although FIGS. 2 and 3 illustrate a substantially rectangular complementary tongue and groove, other complementary sizes or shapes, such as triangular shapes, may be utilized.

Figure 4:
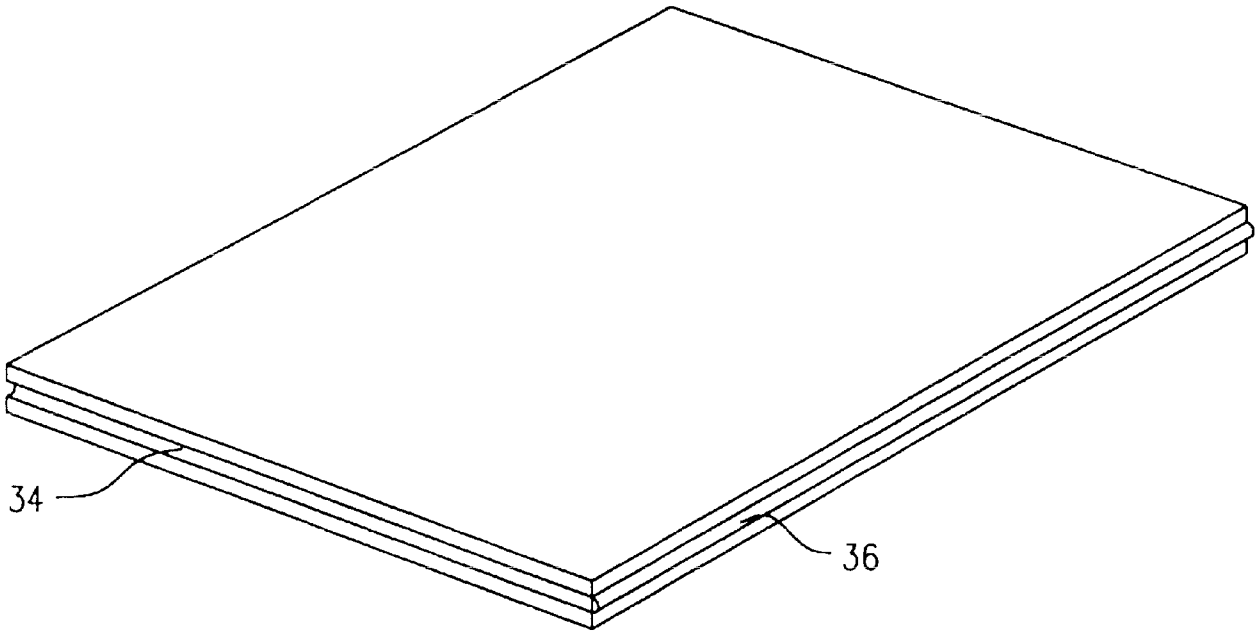
FIG. 4 is a perspective view of the tongue and groove edges of a composite wood panel in accordance with an alternative embodiment of this invention.

Alternatively, the tongue and groove joints of this invention may further be utilized along the width of two complementary wood panels. Accordingly, a wood panel may have a tongue along a first longitudinal edge and a first width edge complementing a groove along the a second longitudinal edge and a second width edge. As a result, complementary wood boards may be interconnected with tongue and groove joints along all four edges of the panels. In this way, interconnected wood panels may swell along both their length and width, without undesired stress and pressure along the panel edges. FIG. 4 is a perspective view of the alternative embodiment described above wherein a tongue 32 is shown along a first longitudinal edge and a groove 34 is shown along a second width edge. Although not shown in FIG. 4, a groove runs along a second longitudinal edge and a tongue runs along a first width edge. Optionally, tongue and groove joints may be placed, or be absent, along any of the four edges of the panels, in any order or fashion, as needed by the user.

Preferably, the composite wood panels are lignocellulosic wood composites comprising multiple wood parts (e.g., wood strands, flakes, particle chips dust, etc.) bonded together with a thermoset binder resin and wax. In particular, the preferred wood composites are oriented strand board, such as described in U.S. Pat. Nos. 5,525394 and 5,635,248, herein incorporated by reference. Regardless, the tongue and groove joints of this invention may be utilized with any interconnecting wood material, such as plywood or solid wood products, to form strong tongue and groove joints which allow for subsequent expansion of the interconnected wood panels, without the detrimental effects resulting from stress along the interconnected panel edges.

We claim:

1. A composite wood panel, having parallel first and second longitudinal edges, comprising:

a groove formed along said first longitudinal edge, said groove having two sides and a base transverse thereto, a tongue, complementary to said groove, formed along said second longitudinal edge, said tongue having an upper side wall and a lower side wall and a head extending outward from said second longitudinal edge, thereby forming a juncture between the side walls of the tongue and the second longitudinal edge, and a shoulder located at the juncture of said lower side wall and the second longitudinal edge, said shoulder is located at the juncture of said lower side wall and said second longitudinal edge;

whereby upon engaging said tongue into a complementary groove located along a longitudinal edge of a second complementary wood panel, said shoulder will abut the longitudinal edge of said complementary panel preventing the tongue from being completely introduced into said complementary groove, thereby forming a first aperture between the head of the tongue and the base of the complementary groove, and a second aperture between the longitudinal edges above and below the engaged tongue and complementary groove, wherein above the engaged tongue and complementary groove the second aperture extends from the upper side wall to the surface of the panel; and wherein one of the ingredients of the wood composite panel is wood.

2. A composite wood panel according to claim 1 wherein said shoulder is compressible.

3. A composite wood panel according to claim 1 wherein said tongue continues uninterrupted along the length of the second longitudinal edge.

4. A composite wood panel according to claim 1 wherein said composite panel is an oriented strand board panel.

5. A composite wood panel according to claim 1 wherein said groove is further formed along a first width edge of said panel and said tongue is further formed along a second width edge of said panel.

6. A composite wood panel according to claim 1 wherein said shoulder forms a second aperture of 1/16 to 1/8" inches wide between said first and second longitudinal edges.

7. A tongue and groove joint comprising, a first composite wood panel having a groove formed along a first longitudinal edge, said groove having two sides and a base transverse thereto, a second composite wood panel having (i) a tongue, complementary to said groove, formed along a second longitudinal edge, said tongue having two side walls and a head extending outward from said second longitudinal edge, thereby forming a juncture between the side walls of the tongue and the second longitudinal edge, and (ii) a shoulder located at the juncture between a side wall of the tongue and the second longitudinal edge wherein upon engaging the first and second panel to form a tongue and groove joint, said shoulder will abut the first longitudinal edge, preventing the tongue from being completely introduced into said groove, thereby forming a first aperture between the head of the tongue and the base of the groove, and a second aperture between the first and second longitudinal edge above and below the engaged tongue and groove, wherein above the engaged tongue and complementary groove the second aperture extends from the upper side wall to the surface of the panel.

8. A tongue and groove joint according to claim 7 wherein said tongue has an upper side wall and a lower side wall and wherein said shoulder is located at the juncture of said lower side wall and said second longitudinal edge.

* * * * *

UNITED STATES PATENT AND TRADEMARK OFFICE

CERTIFICATE OF CORRECTION

PATENT NO. : 6,675,544 B1
DATED : January 13, 2004
INVENTOR(S) : Nian-hua Ou Jianhua Pu It is certified that error appears in the above-identified patent and that said Letters Patent is hereby corrected as shown below:

Column 4,
Line 61, cancel beginning with “, said shoulder” to and including “second longitudinal edge”.

Signed and Sealed this

Twenty-seventh Day of July, 2004

JON W. DUDAS
*Acting Director of the United States Patent and Trademark Office*